US007594504B1

(12) United States Patent
Lian

(10) Patent No.: US 7,594,504 B1
(45) Date of Patent: Sep. 29, 2009

(54) PRESSURE ADJUSTABLE MECHANISM FOR PAINT BALL GUNS

(75) Inventor: Sheng-Jen Lian, Taichung County (TW)

(73) Assignee: Gan Yao-Gwo, Taichung (TW)

( * ) Notice: Subject to any disclaimer, the term of this patent is extended or adjusted under 35 U.S.C. 154(b) by 0 days.

(21) Appl. No.: 12/076,960

(22) Filed: Mar. 26, 2008

(51) Int. Cl.
*F41B 11/00* (2006.01)

(52) U.S. Cl. ..... 124/76; 124/73; 124/71

(58) Field of Classification Search ..... None
See application file for complete search history.

(56) References Cited

U.S. PATENT DOCUMENTS 5,613,483 A * 3/1997 Lukas et al. ..... 124/73
6,003,504 A * 12/1999 Rice et al. ..... 124/73
6,959,703 B1 * 11/2005 Spurlock et al. ..... 124/74
6,973,748 B2 * 12/2005 Rice ..... 42/69.01
7,237,544 B2 * 7/2007 Jones ..... 124/73
2002/0096164 A1 * 7/2002 Perrone ..... 124/77
2003/0079731 A1 * 5/2003 Dobbins ..... 124/76
2003/0178018 A1 * 9/2003 Cherry ..... 124/76
2004/0187929 A1 * 9/2004 Carroll ..... 137/505.25
2006/0249132 A1 * 11/2006 Gabrel ..... 124/70

* cited by examiner

*Primary Examiner*—Michael Carone
*Assistant Examiner*—Samir Abdosh
(74) *Attorney, Agent, or Firm*—Shia Banger

(57) ABSTRACT

A paint ball gun includes a barrel, a handle with a trigger connected thereto and a tubular portion which is located beside the barrel. The tubular portion includes a chamber in which a strike pin and a valve are located. A rod movably extends through the valve and has a first end and a second end. The strike pin hits the first end of the rod by pulling the trigger and an activation member is connected to the second end of the rod. The second end of the activation member movably extends into a tubular member engaged with the chamber and biased by a spring. A stop member is movably engaged with the tubular member and in contact with the second end of the activation member. By adjusting the compressing of the spring by moving the stop member, the pressure that shoots the paint balls can be adjusted.

4 Claims, 7 Drawing Sheets

PRESSURE ADJUSTABLE MECHANISM FOR PAINT BALL GUNS

BACKGROUND OF THE INVENTION (1) Field of the Invention

The present invention relates to a paint ball gun and more particularly, to a pressure adjustable paint ball gun.

(2) Description of the Prior Art

A conventional paint ball gun uses pressurized air to shoot paint balls and the mechanism for introducing pressurized air into the barrel is shown in FIG. 1 and generally includes a barrel "E" and a chamber "C" which is located beneath the barrel "E" in parallel. Paint balls are supplied into the barrel from a hopper unit on a top of the barrel "E" and a communication hole "E1" is in communication between the barrel "E" and the chamber "C". A strike pin "A" and a valve "D" are located in the chamber "C" and a rod "B" movably extends through the valve "D". The valve "D" includes a radial hole "D1" which is in communication with the communication hole "E1". An end member "G" is fixed to the first end of the rod "B" and a spring "F" is biased between a protrusion "G1" of the end member "G" and a fixed part in the chamber "C". By the spring "F", the end member "G" seals the communication between the chamber "C" and the valve "D". When pulling the trigger (not shown), the strike pin "A" moves to hit the second end of the rod "B" which pushes the end member "G" away from the valve "D" so that pressurized air from the air source enters the chamber "C" and then the valve "D" and the barrel "E" via the radial hole "D1" and the communication hole "E1" to shoot the paint ball in the barrel "E".

It is noted that when the rod "B" is pushed by the strike pin "A", the movement of the rod "B" has to overcome the resistance force caused by the pressurized air applied to the end member "G" and the spring force from the spring "F". Therefore, the electric motor that drives the strike pin "A" has to consume more electric power during each shooting. Besides, a significant reaction force applies to the paint ball gun when the strike pin "A" hits the rod "B" if the strike pin "A" is driven by higher electric power, the reaction force affects the precision of shooting. The spring "F" may be fatigue within short period of time. U.S. Patent Published No. 2006/0011185 discloses an improved structure to reduce the area of the end member so that the force applied to the rod can be reduced. Nevertheless, no pressure adjustable device is provided to adjust the shooting speed of the paint balls according to needs.

The present invention intends to provide a paint ball gun wherein the force that the strike pin moves the rod can be adjusted so as to change the period of time which allows the pressurized air to enter into the barrel.

SUMMARY OF THE INVENTION

The present invention relates to a paint ball gun that comprises a barrel having a bore defined therein which communicates with a hopper unit. A handle is connected to the barrel and includes a tubular portion which is located beside the barrel. The tubular portion includes a chamber defined therein and a strike pin is movably located in the chamber of the tubular portion. A valve is located in the chamber of the tubular portion and includes a radial hole which communicates with a communication hole defined through a wall of the barrel. An inlet is defined through a wall of the tubular portion and communicates with a source of pressurized air. A rod movably extends through the valve and a gap is defined between the rod and an inner periphery of the valve. The rod has a first end protruding out from an end of the valve and facing the strike pin, a second end of the rod protrudes out from the other end of the valve and is connected with an end member on a first end of an activation member. A second end of the activation member movably extends into a tubular member engaged with the chamber. The end member removably seals an opening of the valve. A spring is adjustably received in the tubular member and the second end of the activation member is biased by the spring.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
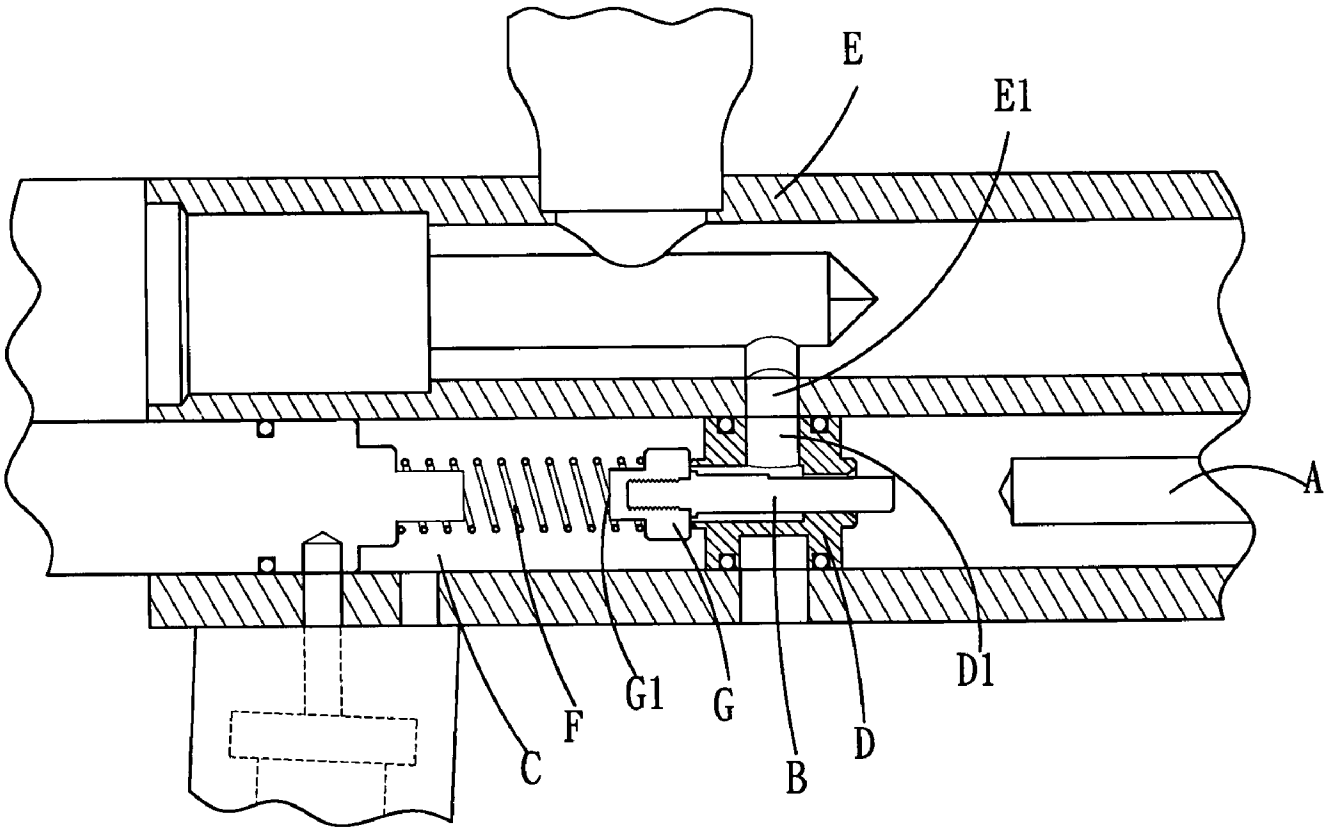
FIG. 1 Prior Art
FIG. 1 is a cross sectional view to show the valve, the rod in the valve, the spring biasing the rod and the strike pin of a conventional paint ball gun.
Figure 2:
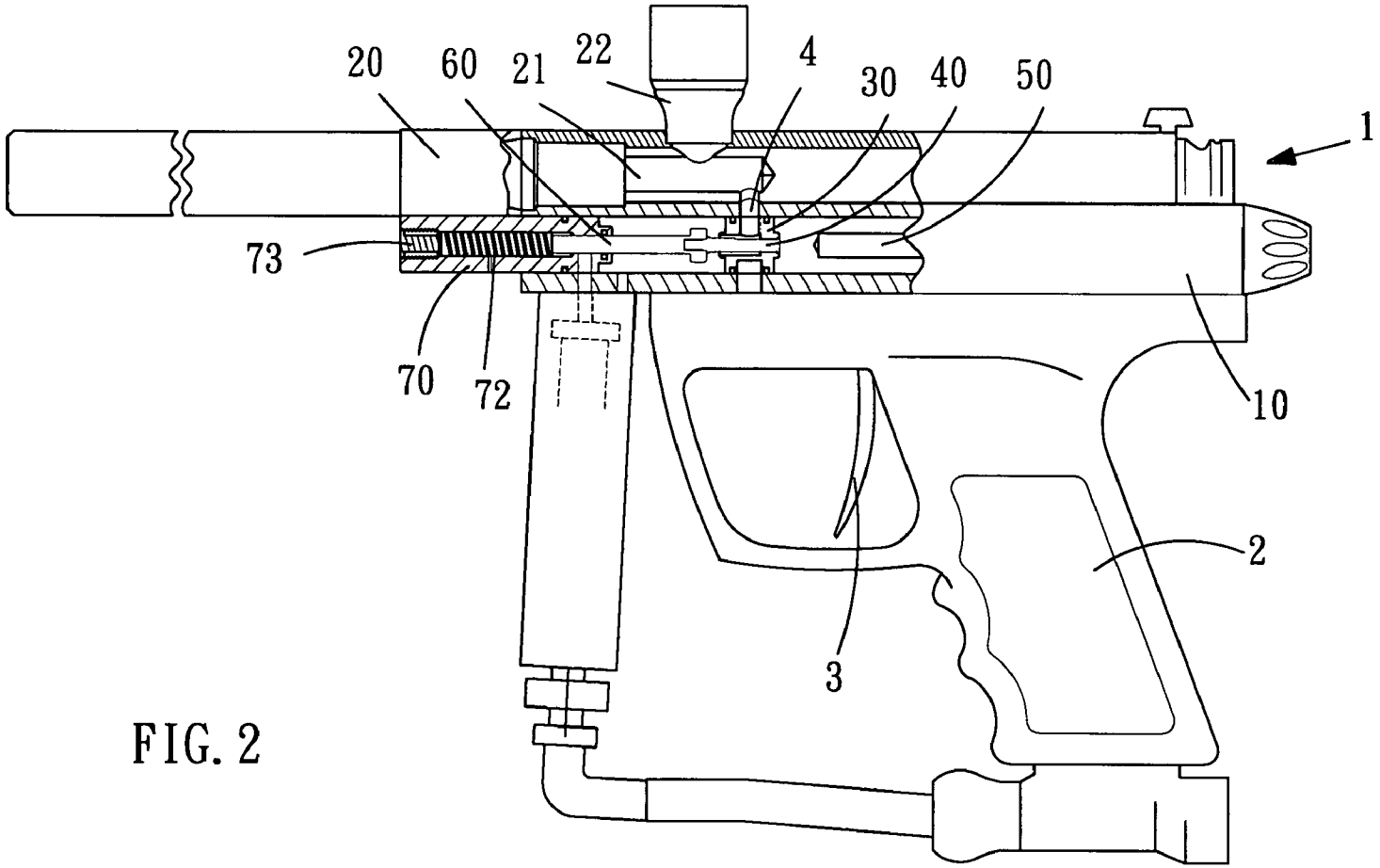
FIG. 2 is a partial cross sectional view of a paint ball gun with the pressure adjustable mechanism of the present invention.
Figure 3:
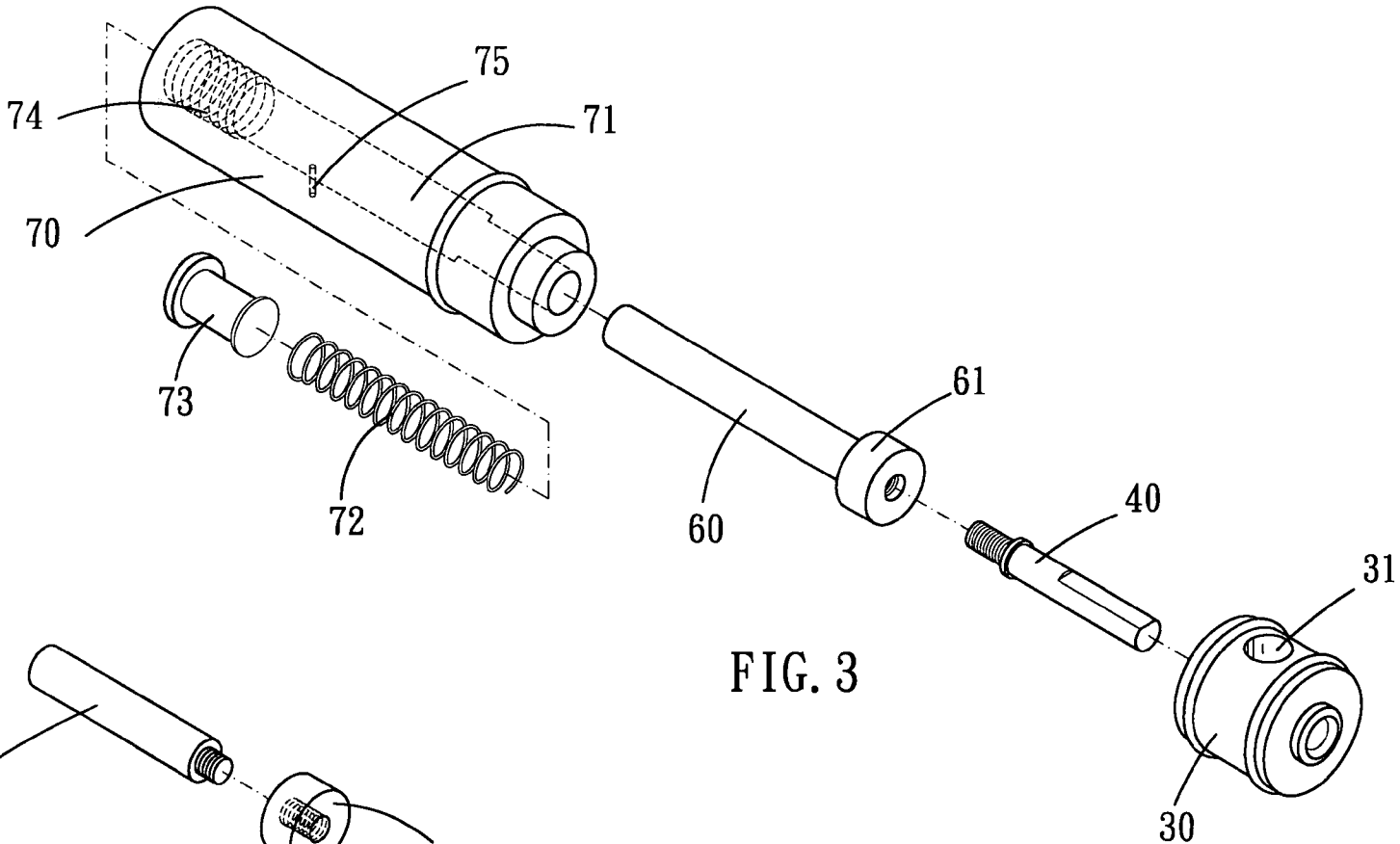
FIG. 3 is an exploded view to show the tubular member, the spring, the end member, the activation member, the rod, and the valve of a conventional of the pressure adjustable mechanism of the present invention.
Figure 4:
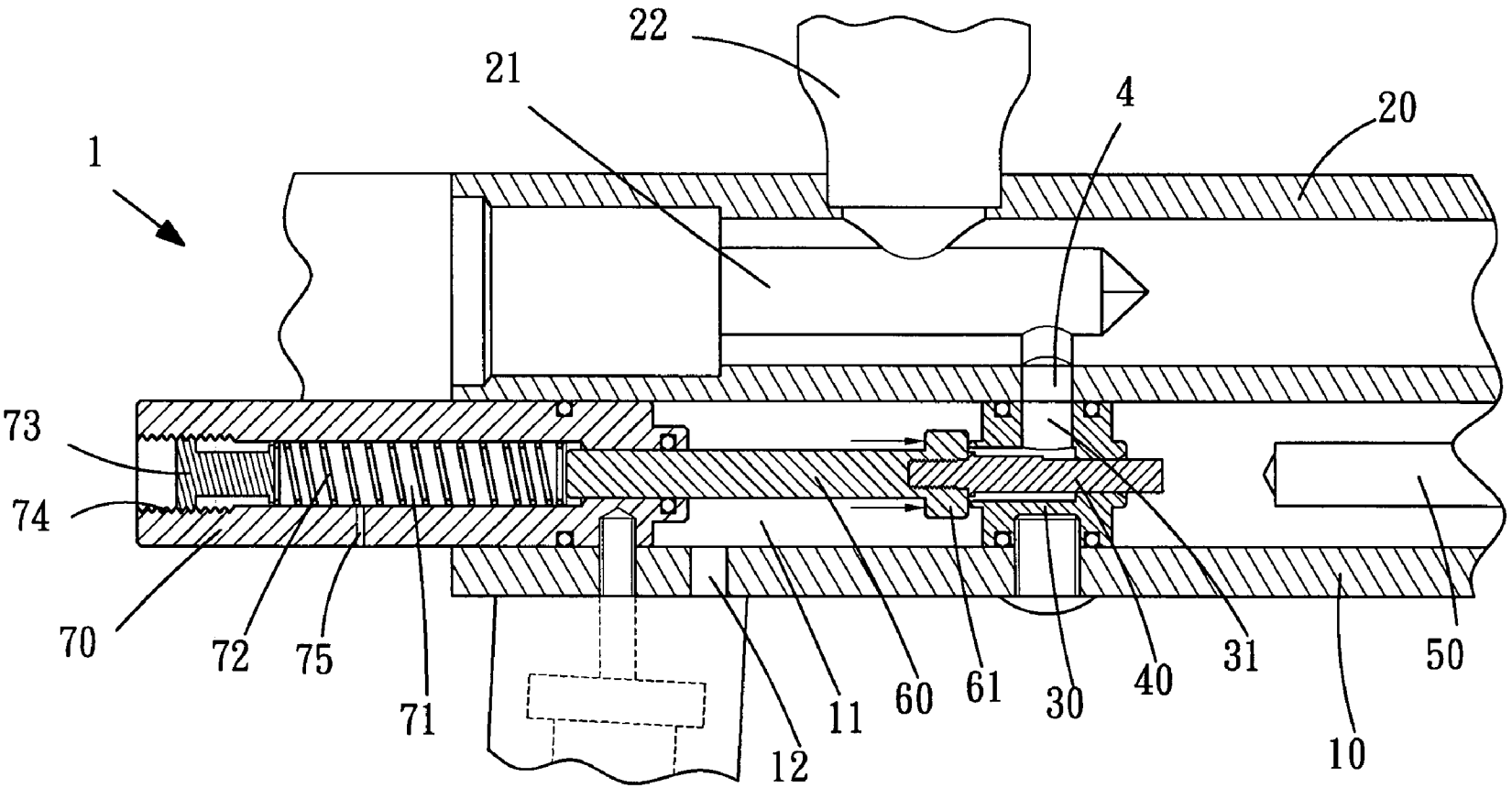
FIG. 4 is a cross sectional view to show the pressure adjustable mechanism of the present invention, wherein the strike pin has not moved to hit the rod.

Referring to FIGS. 2 to 4, the paint ball gun 1 of the present invention comprises a barrel 20 and a handle 2 connected to the barrel 20, a trigger 3 is connected to the handle 2. The barrel 20 has a bore 21 defined therein which communicates with a hopper unit 22 such that paint balls (not shown) are supplied into the bore 21 via the hopper unit 22.

The handle 2 is connected with a tubular portion 10 on a top portion thereof and the tubular portion 10 is located beside the barrel 20 in parallel. The tubular portion 10 includes a chamber 11 defined therein and a strike pin 50 is movably located in the chamber 11 of the tubular portion 10. The strike pin 50 is operated by the trigger 3. A valve 30 is securely located in the chamber 11 of the tubular portion 10 and includes a radial hole 31 which communicates with a communication hole 4 defined through a wall of the barrel 20. An inlet 12 is defined through a wall of the tubular portion 10 and in communication with a source of pressurized air which generally is a pressurized air bottle.

A rod 40 movably extends through the valve 30 and a gap is defined between the rod 40 and an inner periphery of the valve 40. The rod 40 has a first end protruding out from an end of the valve 30 and facing the strike pin 50. A second end of the rod 40 protrudes out from the other end of the valve 30 and is connected with an end member 61 on a first end of an activation member 60. A second end of the activation member 60 movably extends into a tubular member 70 engaged with the chamber 11. The end member 61 removably seals an opening of the valve 30. A spring 72 is adjustably received in the tubular member 70.

The tubular member 70 includes a passage 71 defined longitudinally therethrough and a stop member 73 is movably engaged with the passage 71. The spring 72 is biased between the second end of the activation member 60 and the stop member 73. Inner threads 74 are defined in an inner periphery of the passage 71 of the tubular member 70 and the stop member 73 is threadedly engaged with the inner threads 74 so that the compression of the spring 72 can be adjusted by moving the stop member 73. A release hole 75 is defined through a wall of the tubular member 70 and communicates with the passage 71.

Figure 3A:
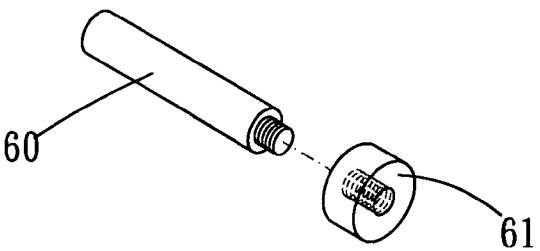
FIG. 3A is an exploded view to show the end member and the activation member.

As shown in FIG. 4, the pressurized air is filled with the chamber 11 in the tubular portion 10 and cannot enter into the valve 30 and the bore 21 because the end member 61 seals the valve 30. It is noted that, as shown in FIG. 3A, the end member 61 includes a threaded passage and the first end of the activation member 60 includes a threaded protrusion which is threadedly engaged with the threaded passage. By this arrangement, the end member 61 can be easily replaced.

Figure 5:
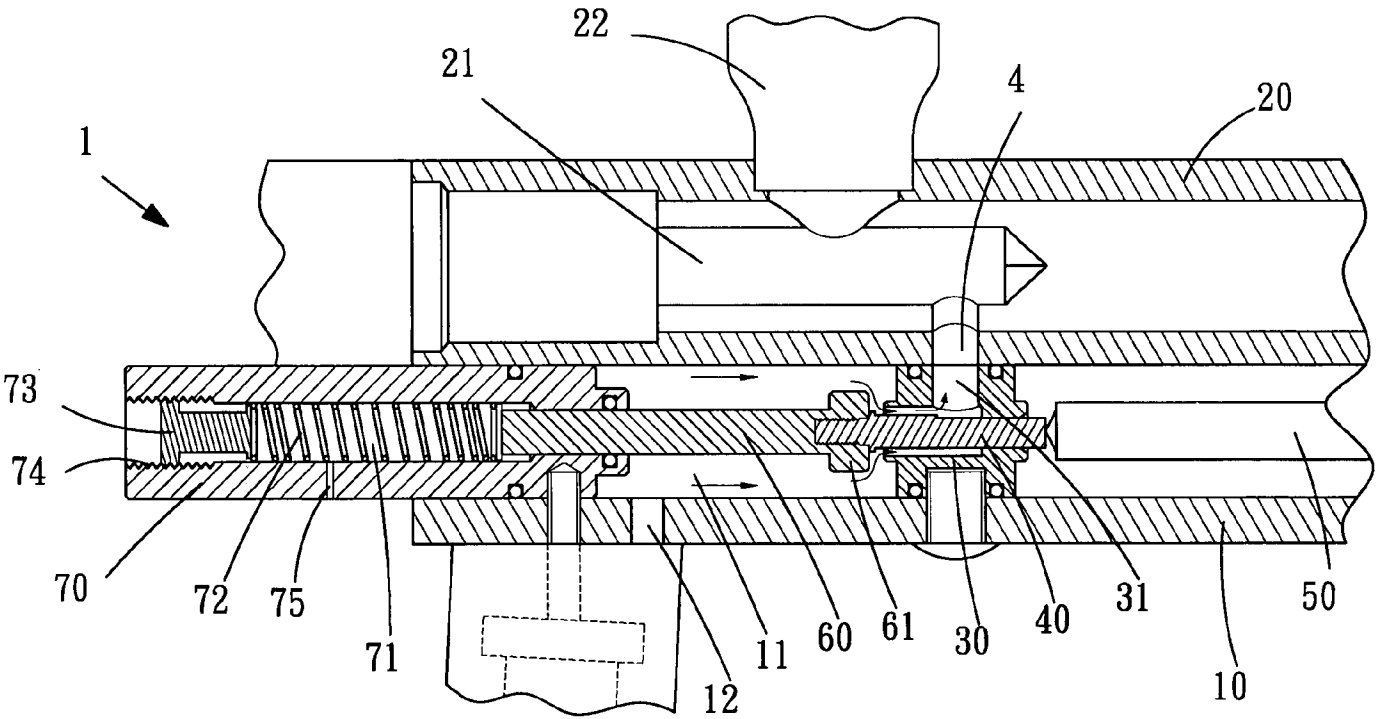
FIG. 5 is a cross sectional view to show the pressure adjustable mechanism of the present invention, wherein the strike pin is moved to hit the rod.

As shown in FIG. 5, when pulling the trigger 3, the strike pin 50 moves to hit the rod 40 so that the activation member 60 is pushed and the end member 61 is removed away from the valve 30. The spring 72 is then compressed and air in the passage 71 released from the release hole 75. The pressurized air enters into the gap between the inner periphery of the valve 30 and the rod 40, and then enters into the bore 21 via the radial hole 31 and the communication hole 4 to shoot the paint ball in the bore 21. When releasing the trigger 3, the rod 40 is pushed by the spring 72 to seal the valve 30 again.

Figure 6:
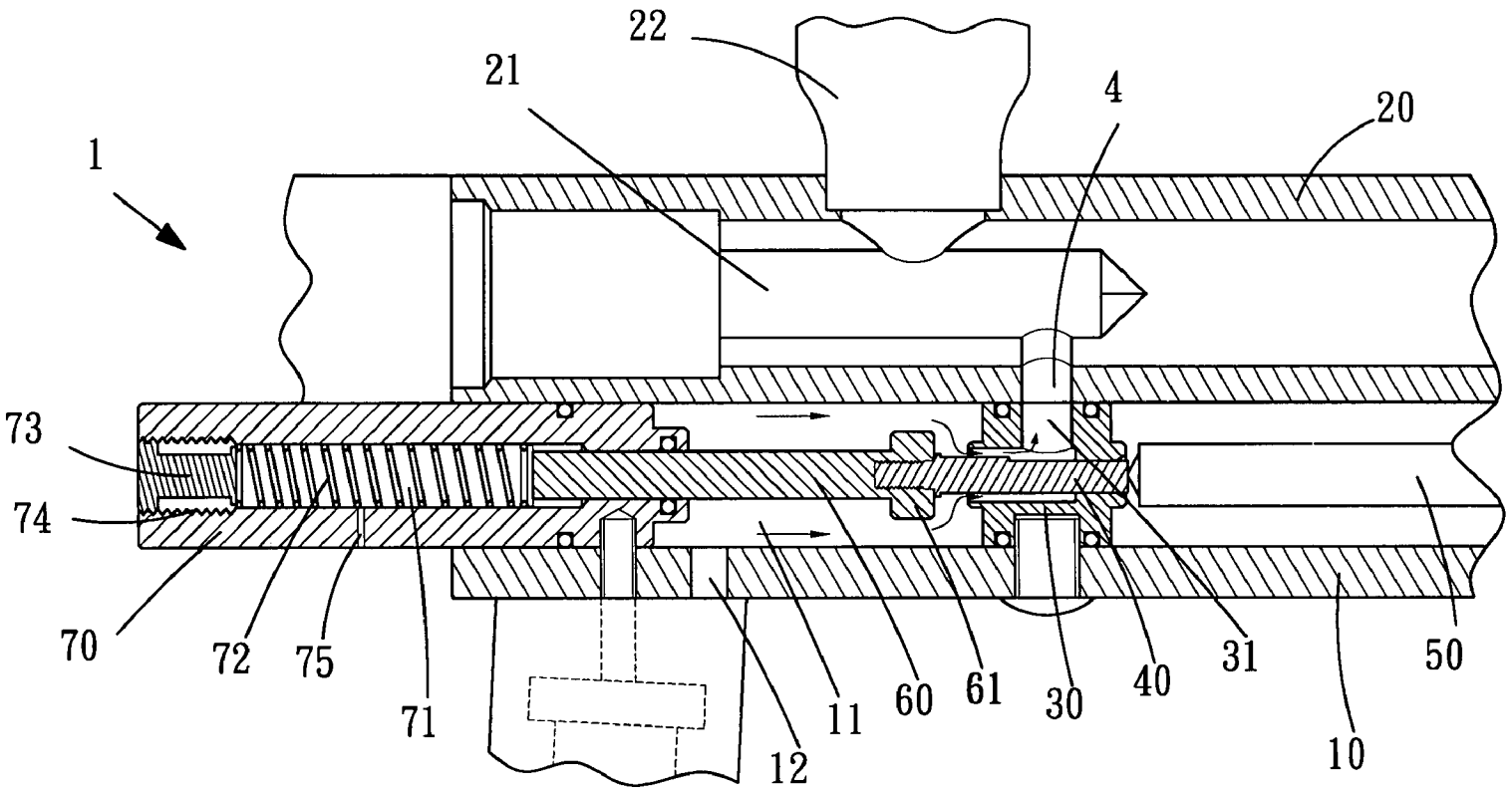
FIG. 6 is a cross sectional view to show that the stop member is moved to adjust the compression of the spring in the tubular member of the pressure adjustable mechanism of the present invention.
Figure 7:
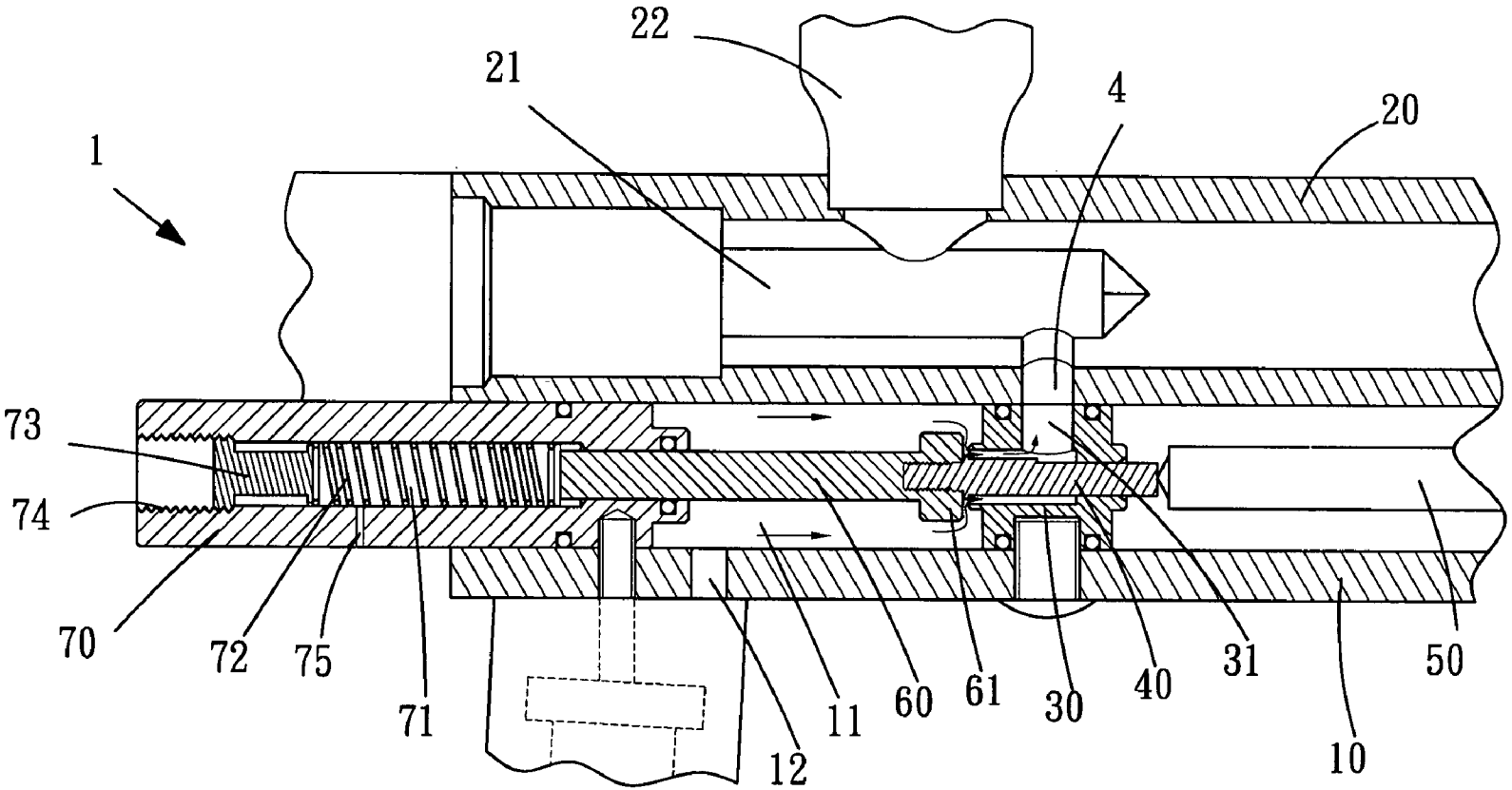
FIG. 7 is a cross sectional view to show that the stop member is moved to another position to adjust the compression of the spring in the tubular member of the pressure adjustable mechanism of the present invention.

The compression of the spring 72 can be adjusted by moving the stop member 73 as shown in FIG. 6, when moving the stop member 73 away from the spring 72, the force that the activation member 60 needs to compress the spring 72 is less than that in the status shown in FIG. 5. In other words, the distance that the spring 72 deformed is longer in FIG. 6 than in FIG. 5, and the distance that the end member 61 away from the valve 30 is longer in FIG. 6. Therefore, more pressurized air enters into the bore 21 if the stop member 73 is positioned in FIG. 6. By repositioning the stop member 73, the amount of pressurized air entering the bore 21 can be adjusted so as to obtain different shooting pressures.

While we have shown and described the embodiment in accordance with the present invention, it should be clear to those skilled in the art that further embodiments may be made without departing from the scope of the present invention.

What is claimed is:

1. A paint ball gun comprising:

a barrel having a bore defined therein which is adapted to communicate with a hopper unit;

a handle connected to the barrel and including a tubular portion which is located beside the barrel, the tubular portion being parallel to the barrel, the tubular portion including a chamber defined therein and a strike pin movably located in the chamber of the tubular portion, a valve located in the chamber of the tubular portion and including a radial hole which communicates with a communication hole defined through a wall of the barrel, an inlet defined through a wall of the tubular portion and adapted to be in communication with a source of pressurized air;

a rod movably extending through the valve and a gap defined between the rod and an inner periphery of the valve, the rod having a first end protruding out from an end of the valve and facing the strike pin, a second end of the rod protruding out from the other end of the valve and connected with an end member on a first end of an activation member, a second end of the activation member movably extending into a tubular member engaged with the chamber, the end member removably sealing an opening of the valve, and a spring adjustably received in the tubular member and the second end of the activation member being biased by the spring wherein the tubular member includes a passage defined longitudinally therethrough and a stop member is movably engaged with the passage, the spring is biased between the second end of the activation member and the stop member.

2. The paint ball gun as claimed in claim 1, wherein the end member includes a threaded passage and the first end of the activation member includes a threaded protrusion which is threadedly engaged with the threaded passage.

3. The paint ball gun as claimed in claim 1, wherein inner threads are defined in an inner periphery of the passage of the tubular member and the stop member is threadedly engaged with the inner threads.

4. The paint ball gun as claimed in claim 1, a release hole is defined through a wall of the tubular member and communicates with the passage.

* * * * *